US007632418B2

(12) United States Patent
Killey

(10) Patent No.: US 7,632,418 B2
(45) Date of Patent: Dec. 15, 2009

(54) METHOD FOR FORMING NOTE PADS WITH SHAPED EDGES

(75) Inventor: Edward Killey, Syracuse, NY (US)

(73) Assignee: PCI Paper Conversions, Inc., Syracuse, NY (US)

( * ) Notice: Subject to any disclaimer, the term of this patent is extended or adjusted under 35 U.S.C. 154(b) by 628 days.

(21) Appl. No.: 11/317,797

(22) Filed: Dec. 23, 2005

(65) Prior Publication Data

US 2006/0154796 A1 Jul. 13, 2006

Related U.S. Application Data

(60) Provisional application No. 60/638,740, filed on Dec. 23, 2004.

(51) Int. Cl.
*B44C 1/22* (2006.01)

(52) U.S. Cl. ..... 216/40; 216/45; 428/40.1

(58) Field of Classification Search ..... 216/40, 216/45, 54; 493/340, 349; 428/40.1, 423
See application file for complete search history.

(56) References Cited

U.S. PATENT DOCUMENTS

| | | | | |
|---|---|---|---|---|
| 4,678,206 | A | 7/1987 | Leahan | |
| 4,760,239 | A * | 7/1988 | Makin | 219/121.85 |
| 5,011,186 | A | 4/1991 | Bodziak | |
| 5,366,776 | A | 11/1994 | Mertens | |
| 5,464,672 | A | 11/1995 | Jackson | |
| 5,546,313 | A | 8/1996 | Masters | |
| 6,254,960 | B1 | 7/2001 | Chen | |
| 6,286,871 | B1 * | 9/2001 | Spector et al. | 281/15.1 |
| 6,494,981 | B2 | 12/2002 | Chen | |
| D470,174 | S | 2/2003 | Berger | |
| D480,754 | S | 10/2003 | Berger | |
| 6,794,002 | B2 | 9/2004 | Shinbo | |
| 6,939,426 | B2 | 9/2005 | Stambridge | |
| 7,169,346 | B2 * | 1/2007 | Johns et al. | 264/320 |
| 2001/0033077 | A1 | 10/2001 | Chen | |
| 2004/0113348 | A1 * | 6/2004 | Awano | 270/58.07 |

* cited by examiner

*Primary Examiner*—Lan Vinh
(74) *Attorney, Agent, or Firm*—George R. McGuire; David L. Nocilly; Bond Schoeneck & King, PLLC

(57) ABSTRACT

A paper pad having a three dimensional image is disclosed wherein the faces or sides of the pad comprise a plurality of paper sheet edges formed into three dimensional surfaces extending from the common planar surface of the side or indenting into said surface. According to one embodiment, the three dimensional surfaces are created through computer numeric controlled (CNC) carving of a compressed side of the paper pad to create an aesthetically pleasing, complex three dimensional design. According to another embodiment, a shaped die is applied to a compressed side of a paper pad under selected conditions of time, temperature, pressure and humidity to deboss a portion of the paper material and produce a three dimensional design in the surface of the compressed side.

9 Claims, 3 Drawing Sheets

METHOD FOR FORMING NOTE PADS WITH SHAPED EDGES

CROSS REFERENCE

This application claims priority from U.S. Provisional Application 60/638,740, filed Dec. 23, 2004.

FIELD OF THE INVENTION

The present invention relates to paper pads, and more particularly to a method of shaping the sides of paper pads to create a complex three-dimensional or textured surface.

BACKGROUND OF THE INVENTION

The art of manufacturing paper pads is well known, as is decoration of the sides or edges of the pad's sheeted paper layers. Typically, the sheets of a paper pad are attached along a common edge e to keep all the paper sheets together in a cohesive unit for ease of handling. The attachment may be provided by an adhesive, such as elastic polymeric material. According to this method the adhesive is applied to a common edge of the sheets of the pad, such that individual sheets may readily be removed from the pad by pulling away from the adhesive material. According to another method known in the art, a stripe of repositionable adhesive may be applied to a portion of the underside of each sheet adjacent to one edge of the pad. The bond strength of the repositionable adhesive is sufficient to maintain the pad as a cohesive unit, but is not strong enough to prevent individual sheets from being removed from the pad.

In either construction of a note pad, it is desirable to add decoration to the sides of the pad. This decoration may be for artistic or advertising purposes to enhance the appearance and value of the note pad. It is known to decorate the sides of a note pad by applying printing and/or color to a pad's planar side surface. Applying printing and/or color to a pad's unshaped sides, however, limits decorative options to those that can be depicted in a simple plane. In another decorative method disclosed in U.S. Pat. No. 6,494,981 to Chen, shaped dies or cutting blades are used to cut a side of a note pad's pages. Die-cutting, however, allows creation only of simple, non-complex designs, such as simple curves and a variety of angles. Die-cutting, however, cannot produce complex three-dimensional designs because it involves a linear cut, typically perpendicular to the note pad's top surface. In addition, the die that makes the cut to forms the pad's edge is a fixed shape and only useful in production of many copies of the same fixed shape.

What is needed is a note pad having complex, three-dimensional decorations and a method of producing the same. What is also need is a method of forming three-dimensional designs on the sides of note pads that can be easily modified to produce multiple designs. What is also needed is a method of forming note pads with raised relief three-dimensional designs.

SUMMARY OF INVENTION

The present invention provides a method of forming complex, three-dimensional decorations in the sides of paper pads. According to one embodiment of the present invention, a paper pad is compressed to form a stable, rigid and effectively solid surface on at least one side of the pad, then mechanical means are applied selectively to remove paper from the compressed side in much the same way as wood is carved or shaped. To provide for uniform design and expedited production, computer numeric controlled (CNC) milling devices can be used to shape the compressed side of the pad. CNC machines are used in simple milling such as two-axis relief of a material as in routing of wood or metal or in a complex relief that involves complex curves using more than two-axis orientations of the cutting tools.

According to another embodiment of the present invention, a paper pad is compressed to form a stable, effectively solid surface on at least one side of the pad, then a die containing a reversed design is applied to the compressed surface, under controlled conditions of temperature, pressure and humidity, to deboss a portion of the compressed side and form a pattern that includes three-dimensional elements.

DESCRIPTION OF DRAWINGS

The present invention will be more fully understood and appreciated by reading the following Detailed Description in conjunction with the accompanying drawings, in which.

DETAILED DESCRIPTION

Figure 1:
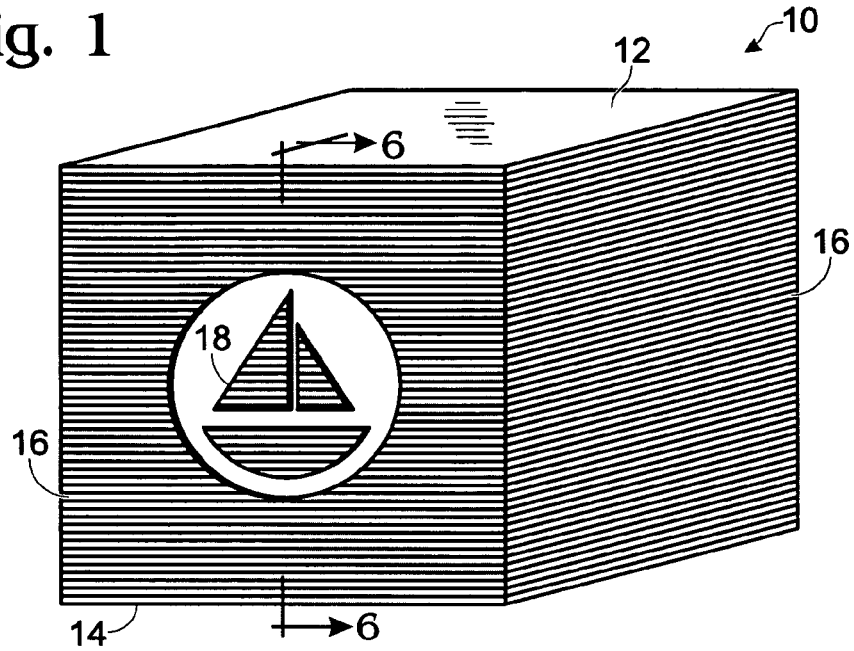
FIG. 1 is a perspective view of a pad having a three-dimensional design according to the present invention.

Referring now to the drawings, wherein like reference numerals refer to like parts throughout, there is seen in FIG. 1 a shaped paper pad 10 according to the present invention. The pad has a top surface 12, bottom surface 14 and sides 16. As is known in the art, adhesive may be applied to retain the individual paper sheets of pad 10. According to the present invention, a three-dimensional design 18 is formed in at least one side 16 of pad 10.

Figure 2:
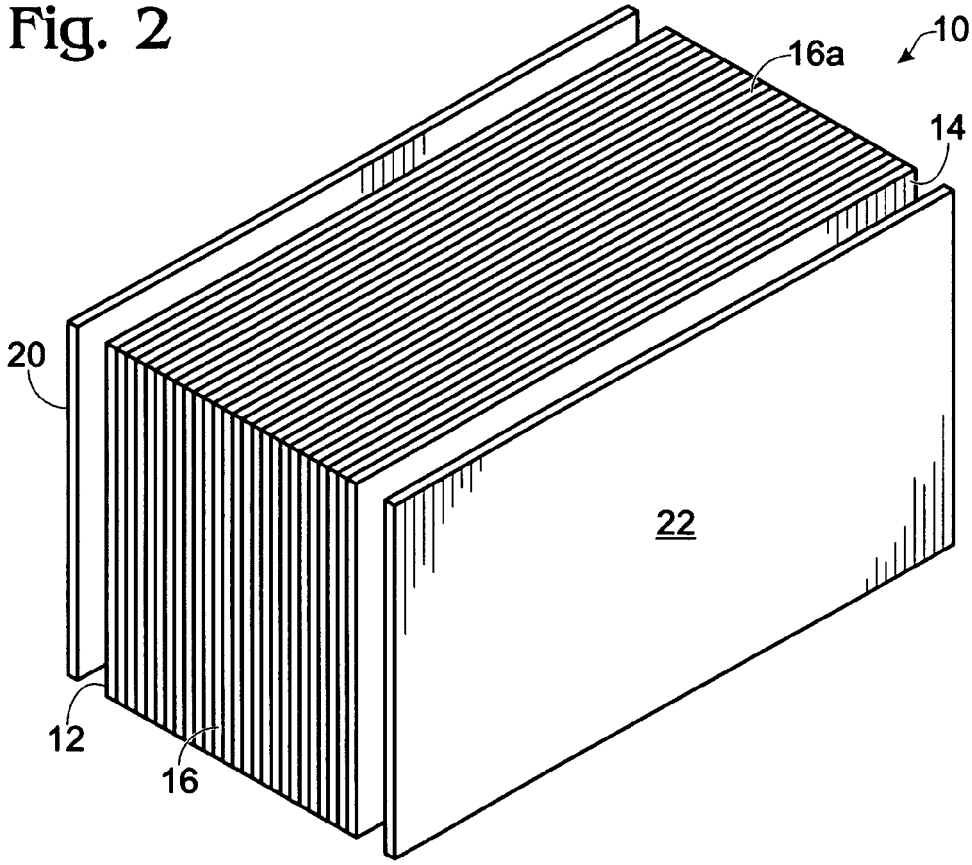
FIG. 2 is an exploded perspective view of a pad before it is shaped according to the present invention.

Referring now to FIG. 2, according to the present invention a pad 10 is provided, comprised of a plurality of individual paper sheets. Pad 10 is compressed between clamps 20, 22 so that compressed side 16*a* forms a stable, rigid and effectively solid surface. Preferably, clamps 20, 22 are at slightly less than the height of pad 10 and are positioned such that their edge is slightly below edge 16*a*. As a minimum, clamps 20, 22 must provide sufficient pressure that the compressed side 16*a* forms a stable, rigid and effectively solid surface. The compressed paper surface lends itself as an ideal wood fiber tooling material in that it has no discernible grain or imperfections that could cause unwanted splintering or cracking that can occur when tooling actual wood.

Figure 3:
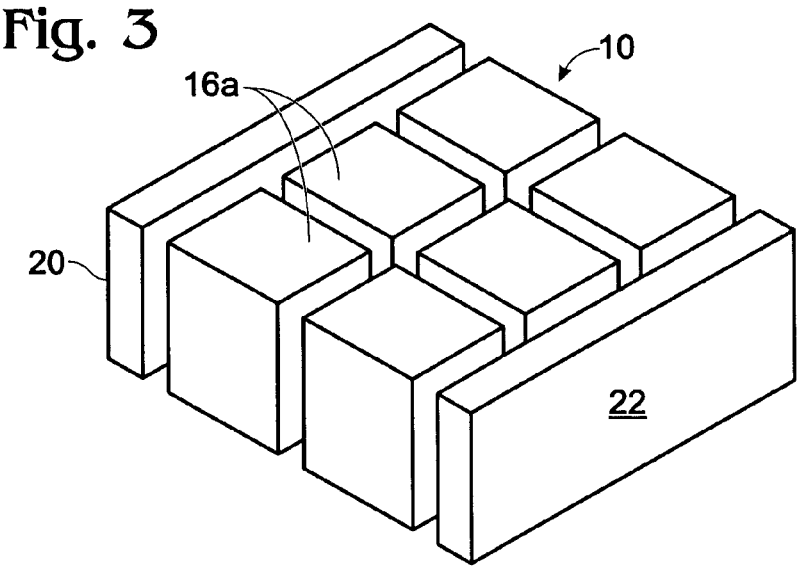
FIG. 3 is an exploded perspective view of an array of pads before they are shaped according to the present invention.

As shown in FIG. 3, according to one embodiment a plurality of pads 10 are compressed at one time between clamps 20, 22. This permits multiple pads 10 to be shaped at the same time, increasing the efficiency of production. Because the pressure applied by clamps 20, 22 forms an effectively solid surface, it generally is not necessary to provide support below the pads 10 or along their lateral edges.

Figure 4:
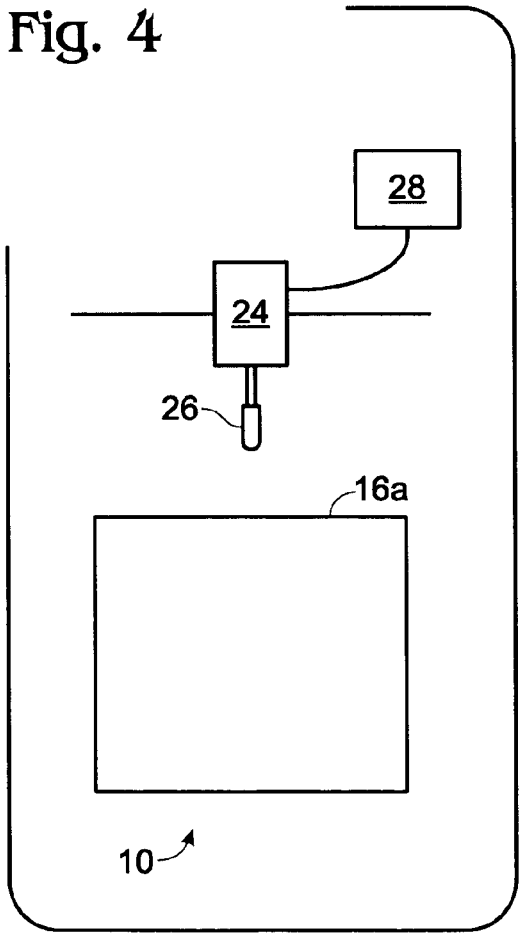
FIG. 4 is a side elevation view of a pad being shaped according to an embodiment of the present invention.
Figure 5:
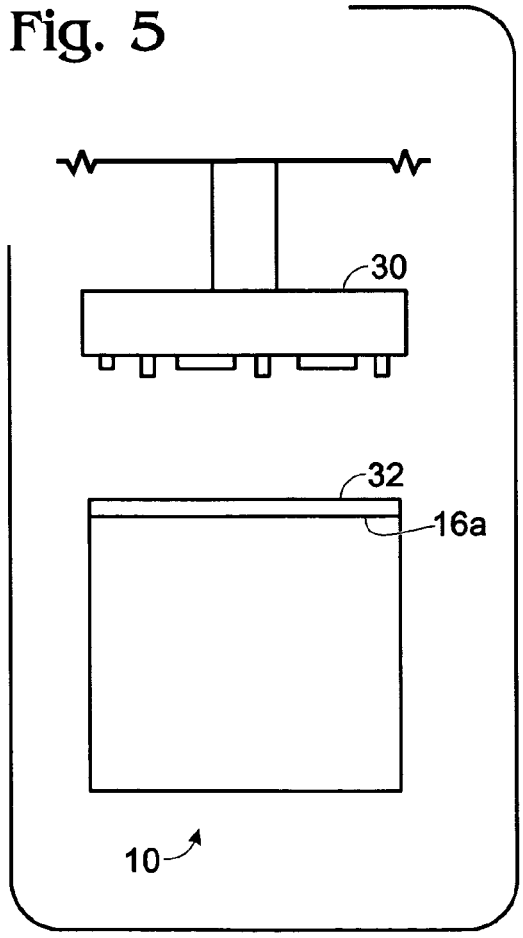
FIG. 5 is a side elevation view of a pad being shaped according to another embodiment of the present invention.

Referring now to FIGS. 4 and 5, after pads 10 are compressed between clamps 20, 22 a variety of shaping techniques can be applied to produce a complex, three dimensional design on side 16*a*. According to one embodiment, paper material is removed from side 16*a* by a cutting tool 24. Acceptable cutting tools 24 include any tool used to shape wood. Preferably, cutting tool 24 is a rotary cutting tool such as a router. Using cutting tool 24 it is possible to form a relief pattern that includes complex three-dimensional shapes by selectively removing paper material from side 16*a*. Preferably, cutting element 26 of cutting tool 24 should be extremely sharp to avoid producing a ragged edge. Operation parameters for cutting tool 24, such as rotation speed, depth of cut and rate of cutting element 26 travel are similar to parameters used to shape wood.

According to the preferred embodiment, the selective removal of paper material from side 16*a* is accomplished through programmable control of the movement of cutting tool 24, for example by use of a CNC device 28. By programming the computer to create a tooled or carved surface, paper may be cut or ground away to form a design 18 comprised of desired image or indicia. Use of a repeatable program makes it possible for the cutting tool 24 to consistently reproduce multiple, high-quality copies of a desired design 18. In addition, using currently available CNC programming techniques, it is possible to generate an image of the desired design 18 on a computer, which then generates the required commands that cause the CNC device to produce the desired design 18 on side 16*a*. Because of the accuracy of the CNC control process, the intricacy of the design 18 applied according to this embodiment is limited only by the size of the cutting element 26 of cutting tool 24.

If desired, side 16*a* can be shaped by multiple passes of cutting tool 24. For example, the CNC device 28 can be programmed to cause cutting tool 24 to make a first pass (or series of passes) to remove large quantities of paper material from selected portions of side 16*a* using a large cutting element 26 and then to make a second pass (or series of passes) to shape a more intricate design in selected portions of side 16*a* using a smaller cutting element 26.

After the pad edges are tooled, the pad is still a functional writing material because the majority of the paper layer face is still intact. The individual sheet edges will be slightly irregular if the carving penetrates only a short distance into the original dimensions of the pad 10. Preferably, paper material is removed to a depth of no more than 25% of the depth of pad 10.

According to the present invention, it is possible to shape some or all of the sides 16 of pad 10. In a pad 10 in which the sheets of the pad are held together by repositionable adhesive applied to a portion of one surface of each sheet, typically along its edge, the side 16 adjacent the repositionable adhesive can be shaped according to the present invention. The repositionable adhesive in the material being shaped typically results in a smooth, aesthetically pleasing appearance. When shaping a side 16*a* containing repositionable adhesive, it is important to control the depth of the design 18 so that each sheet retains a sufficient amount of repositionable adhesive to be functional as a repositionable sheet.

Figure 6A:
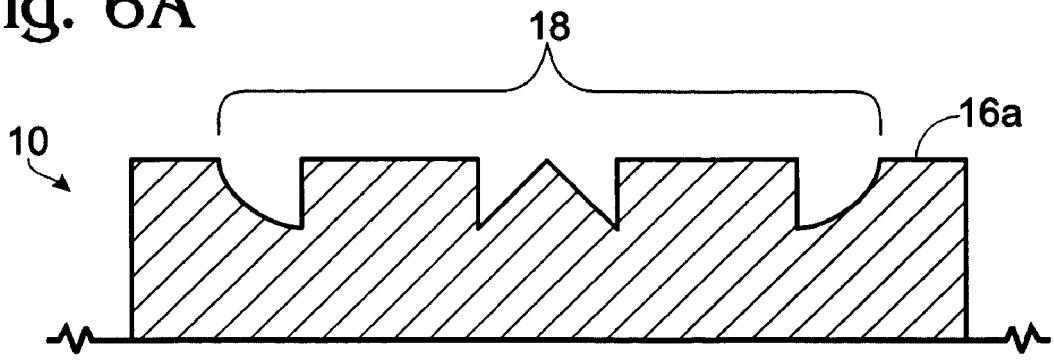
FIG. 6*a* is a partial perspective view as would be seen if taken along line 6-6 of FIG. 1, without reference to any particular design, of a pad according to an embodiment of the invention.
Figure 6B:
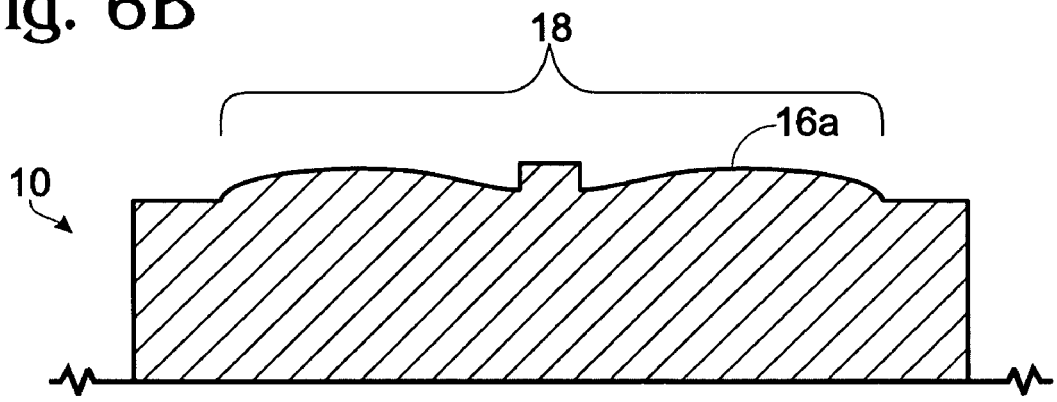
FIG. 6*b* is a partial perspective view as would be seen if taken along line 6-6 of FIG. 1, without reference to any particular design, of a pad according to another embodiment of the invention.

According to this embodiment of the invention it is possible to produce a pad 10 in which the image 18 is carved into the surface of side 16*a* as shown in FIG. 6*a*. Alternately it is possible to produce a pad 10 in which the image 18 appears to project from the surface of side 16*a* as shown in FIG. 6*b*.

According to another embodiment of the invention, after the sides of pad 10 have been compressed, a three dimensional design 18 can be formed in side 16*a* by application of a debossing die 30. While it is known in the art to create three dimensional images in paper by embossing (male and female die) and debossing (using a single die), these techniques have heretofore been applied to produce a three-dimensional image on the surface of a sheet of paper. An alternate embodiment of applicant's invention uses the technique of debossing to produce a three-dimensional image on a side 16*a* of a pad 10.

According to this embodiment, a pad 10 is compressed as previously disclosed. After the pad is compressed, a die 30 is pressed against side 16*a* of pad 10 to produce a three dimensional image. Typically, die 30 is a metal plate that has been tooled with an image. According to this embodiment, the image tooled into die 30 is a reverse of the image desired for the side 16*a* of pad 10. Preferably, the depth of the image 18 should not exceed 2 millimeters. Deeper tooling causes the edges of adjacent paper sheets to "weld" together and makes it difficult to remove individual sheets from pad 10. Die depths in the sub-micron range produce aesthetically pleasing patterns, especially when used in conjunction with a foil 32, as described in more detail below. Preferably the die 30 will be applied to side 16*a* using controlled force such as a mechanical press, pneumatic press, hydraulic press, electric press or other similar device. In addition to selecting a die 30 having a proper depth, it also is possible to select the length of the press stroke to control the depth of the debossed image produced by the die 30.

According to the present invention, die 30 is pressed against pad 10 under controlled conditions of temperature, pressure, depth and humidity. A three dimensional design 18 according to the present invention is produced in a pad 10 having typical moisture content of 4-6%, by forcing a heated die 30 against side 16*a*. Preferably, die 30 is heated to a temperature of at least 250° F., and preferable a temperature between 285° and 400° F. Typically, the die 30 should be applied to side 16*a* for a dwell time of 1 to 5 seconds, but the dwell time can be varied inversely with the temperature of the die 30. For example, similar results can be achieved with a dwell time of 3 seconds at 285° when compared with a dwell time of 1 second at 400° F. Higher die 30 temperatures increase the rate of debossing, but also increase the risk that paper fibers at the edges of adjacent sheets will felt together and prevent easy removal of single sheets from the paper pad 10.

Applicant has achieved satisfactory results using a die 30 having surface area of approximately 9 square inches forced by a pneumatic press driving a 2" diameter ram under 40-80 psi. Those skilled in the art will recognize that other methods of applying pressure can be substituted for an air press and that the specific conditions of heat, time and temperature can be modified to achieve similar results. For example, larger or smaller dies can be used to apply a three dimensional pattern or design over larger or smaller areas.

Figure 6C:
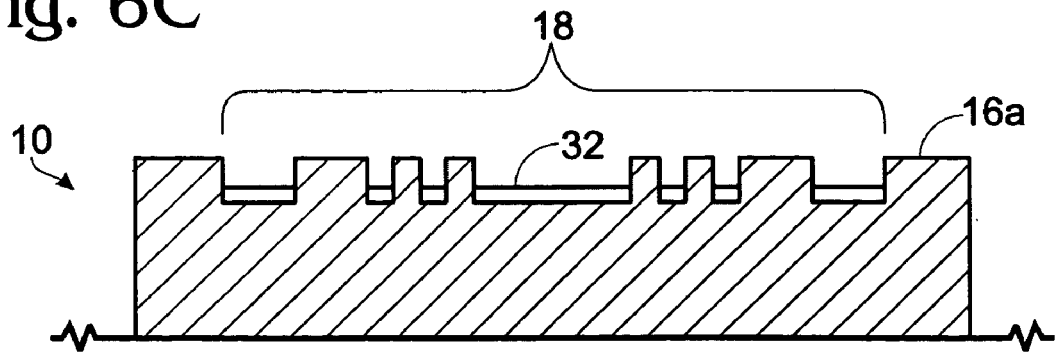
FIG. 6*c* is a partial perspective view as would be seen if taken along line 6-6 of FIG. 1, without reference to any particular design, of a pad according to another embodiment of the invention.

The present invention also includes the addition of foil material 32 to the debossed image or design. Without foil material 32, debossing according to the present invention produces an aesthetically pleasing three dimensional design 18. Addition of foil material 32, however, increases the aesthetic appeal of the three dimensional design 18. According to this embodiment, foil material 32 in sheet form is placed between die 30 and side 16*a* before the die 30 is pressed against side 16*a*. When pressure is applied to side 16*a* by die 30, the foil material 32 is forced into the three-dimensional design 18 by die 30. Generally, foil material 32 is forced against and adheres to side 16*a* at those locations where die 30 produces the deepest impression on side 16*a*. After debossing, excess foil material 32 is removed, leaving only the portion of foil material 32 that adheres to the deepest projections of die 30, as shown in FIG. 6*c*.

According to the present invention, a debossed image according to this embodiment can be applied to some or all of the sides 16 of pad 10. For a pad 10 in which the sheets of the pad 10 are held together by repositionable adhesive applied to a portion of one surface of each sheet, typically along an edge, the side 16 adjacent the repositionable adhesive can be debossed according to the present invention.

While there has been illustrated and described what are at present considered to be preferred and alternate embodiments of the present invention, it should be understood and appreciated that modifications may be made by those skilled in the art and that the appended claims encompass all such modifications that fall within the full spirit and scope of the present invention.

What is claimed is:

1. A method of forming three-dimensional features in a side of a pad comprised of a plurality of sheets of paper comprising a plurality of side surfaces, comprising the steps of:

providing a pad, said pad having a first surface, a second surface and a plurality of side surfaces;

applying pressure to said first surface and said second surface to compress the pad and produce a compressed side comprising said plurality of said side surfaces that is stable and presents a solid surface;

applying an image forming tool to said compressed side; and removing pressure from said first surface and said second surface.

2. The method of claim 1, comprising the step of applying an image forming tool comprises selectively removing paper material from said compressed side.

3. The method of claim 2 wherein the step of selectively removing includes controlling the image forming tool using a computer program.

4. The method of claim 2, wherein said selectively removing step is performed using a cutting tool.

5. The method of claim 4, wherein said cutting tool is a rotary cutting tool.

6. The method of claim 1, comprising the step of applying an image forming tool comprises applying a shaped die to said compressed side to produce a debossed image.

7. The method of claim 6 wherein said step of applying a shaped die includes heating the die to at least 250 degrees F.

8. The method of claim 6 wherein said step of applying a shaped die includes heating the die to between 285 and 400 degrees F.

9. The method of claim 6 wherein said step of applying a shaped die includes exposing said compressed side to steam at a temperature of 240 degrees F. for 2-5 seconds.

* * * * *